US005893190A

United States Patent [19]

Mertz

[11] Patent Number: 5,893,190

[45] Date of Patent: Apr. 13, 1999

[54] MULTI-USE AND MULTI-FUNCTION GOLF EQUIPMENT CLEANING APPARATUS

[76] Inventor: Gregory M. Mertz, 220 4th St. NW., Byron, Minn. 55920

[21] Appl. No.: 08/890,422

[22] Filed: Jul. 9, 1997

Related U.S. Application Data

[63] Continuation-in-part of application No. 08/661,624, Jun. 11, 1996, abandoned.

[51] Int. Cl.[6] ..... A47L 25/00

[52] U.S. Cl. ..... 15/209.1; 15/210.1; 2/23; 2/227

[58] Field of Search ..... 15/208, 209.1, 15/210.1, 215–217, 244.1, 244.3, 244.4; 2/23, 24, 46, 48, 54, 56, 115, 227, 69, 79

[56] References Cited

U.S. PATENT DOCUMENTS

| | | | |
|---|---|---|---|
| 3,045,245 | 7/1962 | Kohen . | |
| 4,215,432 | 8/1980 | Smith . | |
| 4,215,433 | 8/1980 | Pfohl . | |
| 4,510,640 | 4/1985 | Omori . | |
| 4,545,080 | 10/1985 | Gorham . | |
| 4,768,236 | 9/1988 | Klob | 2/227 |
| 5,014,360 | 5/1991 | Smith et al. . | |
| 5,443,875 | 8/1995 | Liu . | |
| 5,765,233 | 6/1998 | Hayes | 15/208 |
| 5,771,523 | 6/1998 | Rudolph | 15/209.1 |
| 5,797,142 | 8/1998 | Debronsky et al. | 15/209.1 |

FOREIGN PATENT DOCUMENTS 2545335 11/1984 France .

*Primary Examiner*—Terrence R. Till
*Attorney, Agent, or Firm*—Dwight N. Holmbo

[57] ABSTRACT

A detachable golf equipment and supply cleaning apparatus includes a substantially flat, flexible, moisture retaining wiping element. The wiping element is comprised of a flexible fabric with sufficient nap to loosen and remove any debris or unwanted matter on the face of a golf club. A pressure sensitive adhesive is secured to one side of the wiping element. The pressure sensitive adhesive is protected via a release backing sheet with a release coating on its inner surface that engages the adhesive layer. When the release backing sheet is removed, the wiping element can be selectively applied, removed and reapplied multiple times to a golfer's skin, clothing, equipment or other selected curved, flat or irregular surface as desired without adverse effects to either the wiping element or any of the aforesaid skin, clothing, equipment or other selected surfaces.

20 Claims, 4 Drawing Sheets

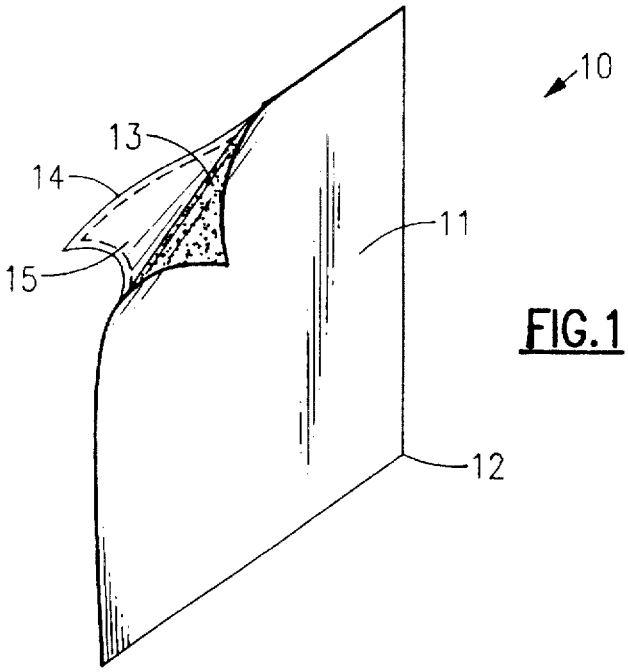
FIG.1
FIG.2
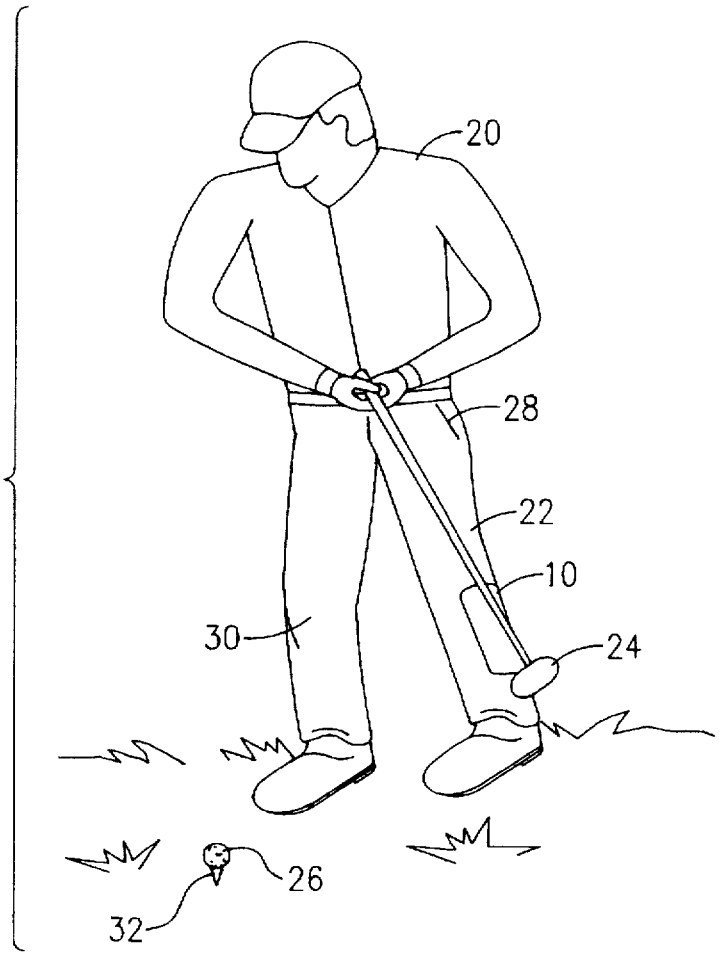

MULTI-USE AND MULTI-FUNCTION GOLF EQUIPMENT CLEANING APPARATUS

This Application is a Continuation in Part of U.S. patent application Ser. No. 08/661,624, now abandoned, filed Jun. 11, 1996, by the present inventor, and entitled Detachable Golf Equipment Cleaning Apparatus.

BACKGROUND OF THE INVENTION

1. Field of the Invention

The present invention relates to golf club cleaning apparatus and more particularly relates to a multi-use apparatus suitable for cleaning golf club heads and other golf equipment, but also easily adapted for use as a versatile logo device.

2. Description of the Prior Art

Golf is a game that is growing in popularity for various reasons. Some players simply enjoy being outdoors while others enjoy the competitive aspects of the game, or are otherwise drawn to the challenge of the game. Many individuals become sufficiently skilled at the game thereby allowing them to compete professionally. Golfers making over one million dollars annually are not uncommon. Those players seeking to improve their game, whether for profit or pleasure, are usually dedicated and disciplined. They carefully think each shot through by studying the terrain, the wind, and condition of the grass. Like a baseball player, many golfers perform a near ritual of actions prior to striking the ball. It is very common to see a player carefully preparing to hit the ball by adjusting everything from their grip to their toe orientation. Just prior to taking the shot, they step forward to take a critical practice swing. The player swings the club, follows through and visualizes the trajectory of an imaginary ball. This ritual, or pre-shot routine, is very important to maintaining confidence and consistency in the golfer's swing. Any interruption to this ritual will likely have a negative impact on the golfer's game.

When a golfer takes the aforesaid practice swing, the golf club frequently hits the ground and pulls up a chunk of grass creating a divot. When this event occurs, the face of the golf club becomes soiled with bits of grass, roots, and/or dirt. Prior to striking the ball, the golfer must then clean the face of the golf club. The process of cleaning the clubface interrupts the golfer's concentration and visualization of the pending shot. Consequently, the golfer may not hit the ball in the manner desired.

Golfers have several known choices for cleaning the face of the golf club. Some players will wipe the face of the club against their pant leg. This leaves a soiled area on the golfer's clothing that will remain until the clothes are laundered. This intentional soiling of the clothes is not always understood or appreciated by the person doing the laundry. The end result is tension that potentially inhibits the golfer.

Golfers may elect to attach a wiping apparatus to their shoes such as described in U.S. Pat. No. 4,122,577, issued Oct. 31, 1978. The apparatus disclosed in the '577 patent is directed to a compliant blade secured to a plate that is attached to the cleats in the sole of the golfer's shoe. To use this apparatus, the golfer must lift his shoe and wipe the face of the golf club head across the blade. The aforesaid action disrupts the golfer's form, balance and concentration. Further, the apparatus has been declared illegal for use in any sanctioned golf competition. It is known by those skilled in the art of golfing that present golf rules dictate that nothing can be added to improve or change a golfer's stance.

The addition of a plate attached to the cleats of a golf shoe has been deemed to change a golfer's stance. Subsequently, serious golfers have not accepted the aforesaid apparatus.

Golfers may alternatively elect to manually wipe off the face of a golf club with a cleaning cloth. This process is time consuming and exposes the golfer's hands to a progressively dirty cloth. As a result, this process is highly disruptive to maintaining a sharp focus on the pending golf shot.

In view of the above, there has been a long-felt need in the golfing industry for a Rule compliant apparatus and process suitable for cleaning the face of a golf club without disrupting the golfer's concentration prior to addressing the ball.

SUMMARY OF THE INVENTION

The present invention overcomes the disadvantages of known golf club cleaning devices and processes by providing a multi-use, multi-function, relocatable wiping apparatus suitable for cleaning golfing equipment and that is temporarily securable to a golfer's skin or selected golfing apparel and/or golf equipment, or other selected surface as desired. The apparatus includes a substantially flat, flexible and pliable wiping element having a first side suitable for heavy scraping, brushing, and rubbing of golf club heads during multiple 18 hole rounds of golf with no detrimental effects to the wiping element. The wiping element has a suitable adhesive attached to a second side for securely attaching the wiping element to a golfer's skin or selected golfing apparel and/or golf equipment, or other selected surface such that the aforesaid heavy scraping, brushing, and rubbing processes do not impair the adhesion or location of the wiping element or otherwise interfere with a golfer's movement.

A feature of the present invention is the provision of an apparatus and process for cleaning the face of a golf club or other golf equipment and/or supplies, e.g. club grips, shafts, balls, shoes, and the like, in a manner that minimizes or eliminates the disruption to a golfer's concentration.

Another feature of the present invention is the provision of an apparatus and process for cleaning the face of a golf club or other golf equipment and/or supplies without soiling a golfer's clothing.

Yet another feature of the present invention is the provision of an apparatus and process for cleaning the face of a golf club or other golf equipment and/or supplies that eliminates the need for a golfer to touch a club head or a cleaning cloth with his hand(s).

Still another feature of the present invention is the provision of an apparatus for cleaning the face of a golf club or other golf equipment and/or supplies, e.g. golf ball, shoes, grips, shafts, etc., that retains its functionality for at least 18 holes of golf without any noticeable degradation.

Still another feature of the present invention is the provision of an apparatus for cleaning the face of a golf club or other golf equipment, that can be attached to a golfer's skin without interfering with the golfer's movement as he is walking, running, bending, or stretching.

Still another feature of the present invention is the provision of an apparatus for cleaning the face of a golf club or other golf equipment that can be selectively attached to a golfer's skin, clothing, or equipment.

Still another feature of the present invention is the provision of an apparatus for cleaning the face of a golf club or other golf equipment that can be selectively attached to a variety of surface shapes and materials thereby serving as a desired logo or emblem.

Still another feature of the present invention is the provision of an apparatus suitable for cleaning the face of a golf club or other golf equipment that can be selectively and temporarily attached and reattached to a variety of surface shapes and materials multiple times without any degradation in adhesive performance.

One preferred embodiment for the present inventive golf club cleaning apparatus incorporates a raised cotton wiping element having a checker-like pattern on one side and either a 444™ or 444PC™ brand number adhesive tape manufactured by 3M Company of St. Paul, Minn. The most preferred embodiment for the present inventive golf club cleaning apparatus utilizes DURAFELT®, a felt material commercially available from Allied Felt Group Division of Central Shippe located in Butler, N.J. DURAFELT® is preferred because of its ability to also apply screen-printing to its surface without impairing its cleaning functionality.

These and other features of the present invention are achieved by having a golfer attach to their person, e.g. skin or desired clothing such as pant, skirt, socks, shirt, blouse, shorts, hat, etc., or other selected surface, e.g. self-propelled or pull type golf cart, golf bag, golf umbrella, etc., a removable wiping surface onto which a golf club head, grip, shaft, golf ball, etc., can be wiped clean a sufficient number of times to allow a golfer use therefor at least 18 holes of golf After the game, the aforesaid wiping surface can be easily removed and stored for future use, leaving the golfer's clothing or other selected surface free of dirt, debris, etc. A golfer can locate the wiping element to his preference such as to eliminate or minimize any effort required to wipe the head of a golf club or other golf equipment clean. This flexibility allows the inventive apparatus to be easily incorporated into a golfer's ritual or pre-shot routine prior to addressing a ball. At no time during the game does the golfer need to touch a cleaning cloth or a dirty golf club head, dirty golf ball, and the like. The inventive apparatus can have a desired shape and symbol or logo incorporated thereon for use as a sales or marketing tool. The desired symbol or logo can then be attached to a selected surface such as a wall, desk, door, window, vehicle, e.g. fork lift, etc. to promote a particular company, planned function, and the like. The inventive apparatus is sufficiently flexible to allow reliable attachment to a wide variety of surface shapes, e.g. flat, curved, irregular, and materials, e.g. metal, plastic, vinyl, wood, plaster, painted, Formica®, paper, etc.

BRIEF DESCRIPTION OF THE DRAWINGS

Other characteristics and features of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 1 illustrates an isometric view for one preferred embodiment of the present invention;

FIG. 2 illustrates the preferred embodiment of FIG. 1 attached to a golfer's clothing;

Figure 3A:
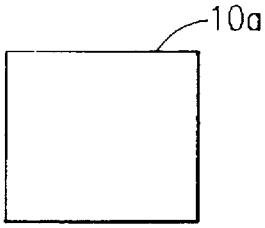
FIGS. 3*a*–3*k* illustrate numerous exemplary alternative shapes that can be used to form the preferred embodiment shown in FIG. 1.

While the above-identified drawing figures set forth alternative embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

The present invention will now be more fully described with reference to the various figures of the drawings, FIG. 1 illustrating one preferred embodiment for the present inventive detachable golf equipment cleaning apparatus 10, including a wiping element 12 having a pressure sensitive adhesive 13, selectively secured to one side thereto. A release backing sheet 14 having a release coating 15 on one side is attached to and protects the pressure sensitive adhesive 13 until ready to be exposed. The release coating 15 engages the adhesive 13 in a manner that allows the release backing sheet 14 to be easily and quickly removed from the wiping element 12 thereby allowing the wiping element 12 to be selectively and temporarily secured to a golfer's skin, clothing, apparel, or other desired surface, e.g. golf equipment such as a cart, bag, umbrella, etc. The present invention is not so limited however, and it will readily be appreciated that the present inventive apparatus can also function as a decorative ornament, logo, symbol, or sales and marketing tool simply by attaching the wiping element 12 to any selected surface such as a wall, post/pole, desk, window, door, machinery, etc. Preferably, the wiping element 12 has a surface 11 comprised of a flexible cloth with sufficient nap to easily loosen and remove any debris or other unwanted foreign matter on the head of a golf club or on a golf ball or other golf equipment. Flexible cloth as used herein includes, but is not limited to cotton, felt, linen, silk, rayon, polyester, wool, nylon, and the like fabrics. The present inventor has found that present inventive cleaning apparatus provides optimal desired functionality when the cleaning element 12 is comprised of DURAFELT® discussed herein above, or similar felt material, or has a patterned, e.g. checker-like raised cotton fabric surface to which the pressure sensitive adhesive 13 is attached. Many other materials and surface characteristics were also tried with varying degrees of success. For example, some fabric materials experimented with included felt, e.g. DURAFELT®, similar cotton blends, flip side of rough cotton, ridged or raised cotton, flip side (smooth) cotton, and rayon/cotton blend.

It is important that no slippage or movement exist between the cleaning element 12 and the pressure sensitive adhesive 13 following repeated usage including heavy scraping, brushing, and rubbing of a golf club head against the cleaning element 12. The present inventor has found that use of either DURAFELT® or a checker-like raised cotton pattern worked best when combined with a 444™ or 444PC™ brand adhesive commercially available from 3M Company of St. Paul, Minn. to provide optimum results.

It is also important that no slippage or movement exist between the cleaning element 12 and the surface to which the cleaning element is applied following the aforesaid repeated usage of heavy scraping, brushing, and rubbing of a golf club head against the cleaning element 12. The present inventor has found that use of the 444™ or 444PC™ brand pressure sensitive adhesive identified herein above provided optimum results. Many alternative adhesives were also utilized with varying degrees of success. Some of these included spray adhesives, Z-ECHO® No. 08012 self-adhesive labels available commercially from most business supply stores, double sided carpet tapes, WEST TAPE® available from West Tape and Label Co. of Denver, Colo., MACTAC STARLINER® permanent adhesive, Fasson & Avery brand adhesives, e.g. clear acetate/adhesive no. 5-395, Fasson "Crack 'n Peel Plus® with various release liners, and 3M Company 442™ and 9589™ brand number adhesives.

The present inventor found that many factors could affect the use and performance of a specific adhesive product in a particular application. For example, the materials to be bonded to the adhesive, the surface preparation of those materials, the specific adhesive selected for use, the conditions in which the product is used, and the duration and environmental conditions in which the product is expected to perform are among the many factors that can affect the use and performance of the specific adhesive product. Given the aforesaid variety of factors that can affect the use and performance of the specific adhesive product, some of which are uniquely within a user's knowledge and control, it was found essential to evaluate a wide variety of specific adhesive products to determine whether it was even possible to create a successful marriage of specific materials and adhesive products suitable for the particular applications as described in detail herein.

The present inventor found that it was possible to create a proper marriage or combination of cleaning element 12 materials and adhesives, as described herein before to 1) control the degree of slippage or movement between the cleaning element 12 and any surface to which the cleaning element 12 is applied; 2) control the degree of slippage or movement between the cleaning element 12 and the pressure sensitive adhesive 13; 3) allow repeated cleaning, e.g. heavy scraping, brushing, and rubbing of a golf club head against the cleaning element 12 for a duration sufficient to last at least 18 holes without any degradation in performance; and 4) allow the cleaning element 12 to be repeatedly secured to and removed from a plurality of surface shapes, e.g. flat, curved, irregular, and materials, e.g. silk, wool, cotton, nylon, rayon, and others such as identified herein above, without any degradation in performance.

Figure 3B:
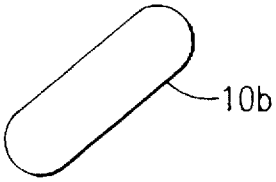

FIG. 2 illustrates the preferred embodiment of the present detachable golf equipment cleaning apparatus 10 shown in FIG. 1 attached to a golfer's 20 clothing. Securing the apparatus 10 to the golfer's pant leg 22 as shown in FIG. 2, allows the golfer 20 to easily clean the face of a golf club 24 without soiling the pant leg 22, or having the golfer 20 get out of position or having the golfer 20 touch a cleaning cloth or a dirty club head prior to addressing a golf ball 26. It will readily be understood that the size and shape of the cleaning apparatus 10 is not limited to that illustrated in FIGS. 1 and 2, and that many other sizes and shapes can be effectively employed as desired. For example, numerous exemplary shapes suitable to accommodate a plurality of user's needs and/or individual tastes are shown in FIGS. 3*a*–3*k*. Each cleaning apparatus 10*a*–10*k* can selectively be formed of cleaning element materials and/or fabrics, each having its own cleaning attributes, as desired. The present inventor has found that materials capable of retaining moisture to be most effective in cleaning and drying golf club heads. Embodiments such as those depicted in FIGS. 3*a*–3*k* can provide users with optimum application flexibility when desired. It will readily be appreciated that larger cleaning apparatus 10 can be attached on a golfer's pant leg 22 for example, to clean the face of a golf club 24 while smaller embodiments of cleaning apparatus 10 can be attached near a pocket 28 or knee 30 when it is desired to wipe a golf ball 26 clean prior to placing the golf ball 26 on a tee 32. As stated herein before, the present inventive cleaning apparatus 10 can also be secured to a golfer's equipment, e.g. bag, cart, umbrella, etc. to add further convenience of use for a golfer 20. As depicted in FIGS. 3*a*–3*k*, the surface 11 of the wiping element 12 can be formed of any desired shape and can even include indicia or no indicia as desired. Exemplary indicia can include, but need not be limited to one or more artistic patterns 32, 33 such as depicted in FIGS. 3*h* and 3*k*, predetermined text 34 such as depicted in FIG. 3*f*, or design logos 36, 38 and 40 such as depicted in FIGS. 3*d*, 3*e*, and 3*j*.

Figure 3C:
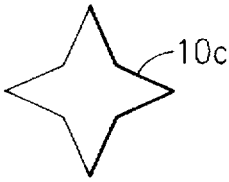
Figure 3D:
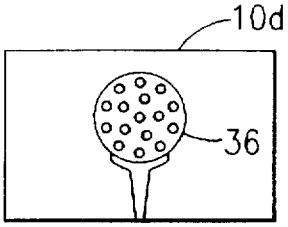
Figure 3E:
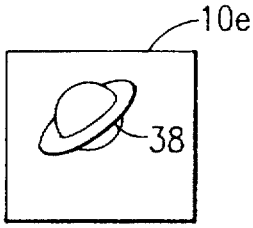
Figure 3F:
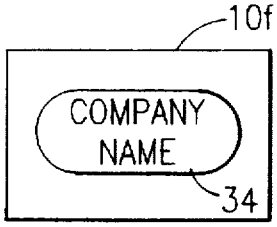
Figure 3G:
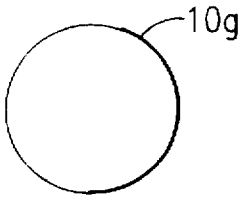
Figure 3H:
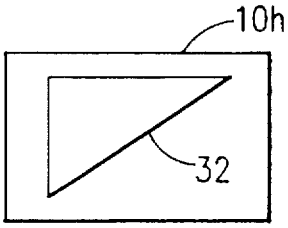
Figure 3I:
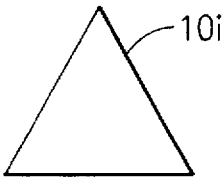
Figure 3J:
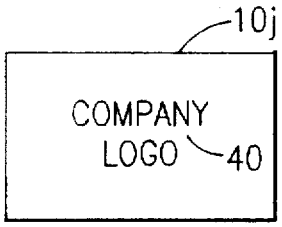
Figure 3K:
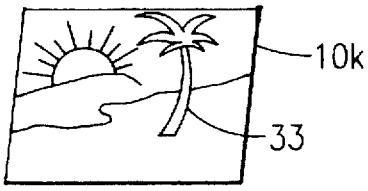
Figure 4A:
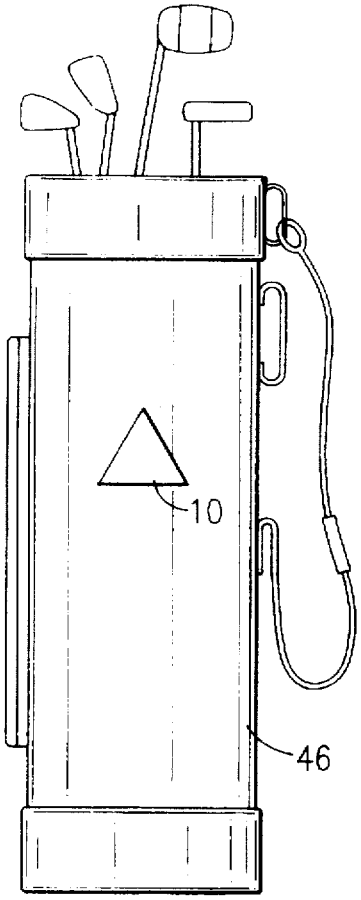
FIGS. 4*a*–4*c* illustrate the different embodiments of the present invention as shown in FIGS. 3*i*, 3*g*, and 3*c* attached to a golf bag, golf cart, and golf umbrella respectively.
Figure 4B:
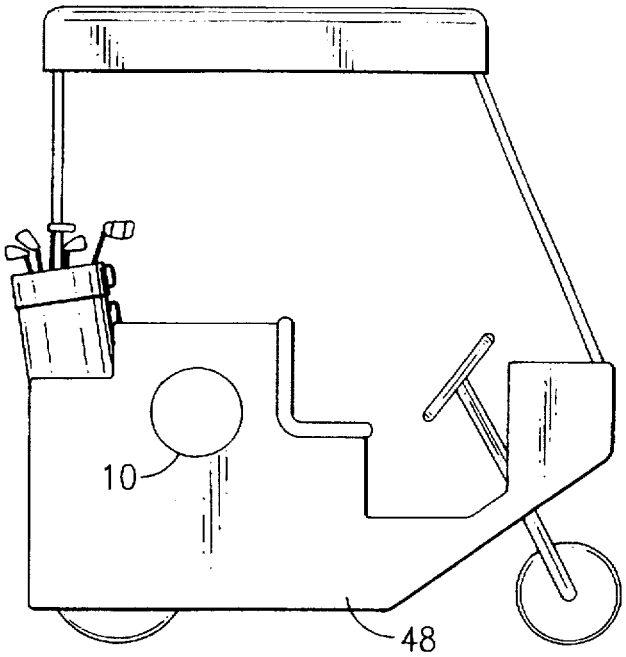
Figure 4C:
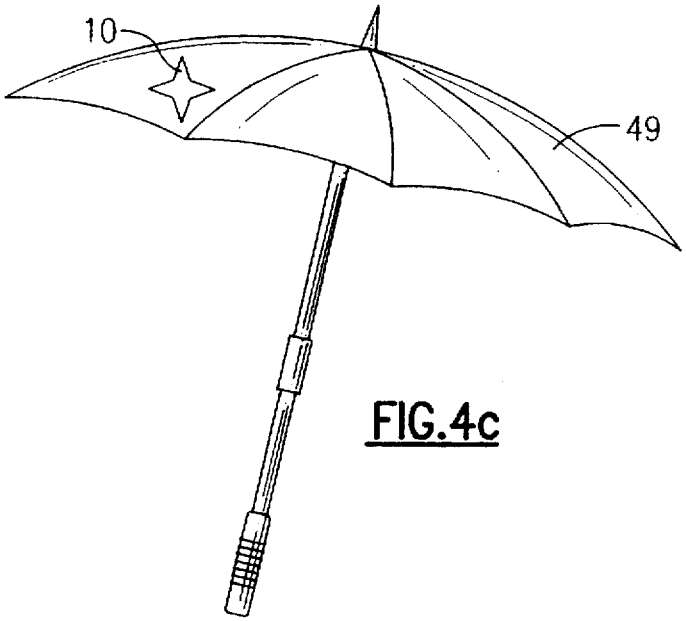

FIGS. 4*a*–4*c* illustrate exemplary embodiments of the present detachable golf equipment cleaning apparatus 10*i*, 10*g* and 10*c* shown in FIGS. 3*i*, 3*g* and 3*c* attached to a golf bag 4*a*, golf cart 4*b*, and golf umbrella 4*c* respectively.

Figure 5:
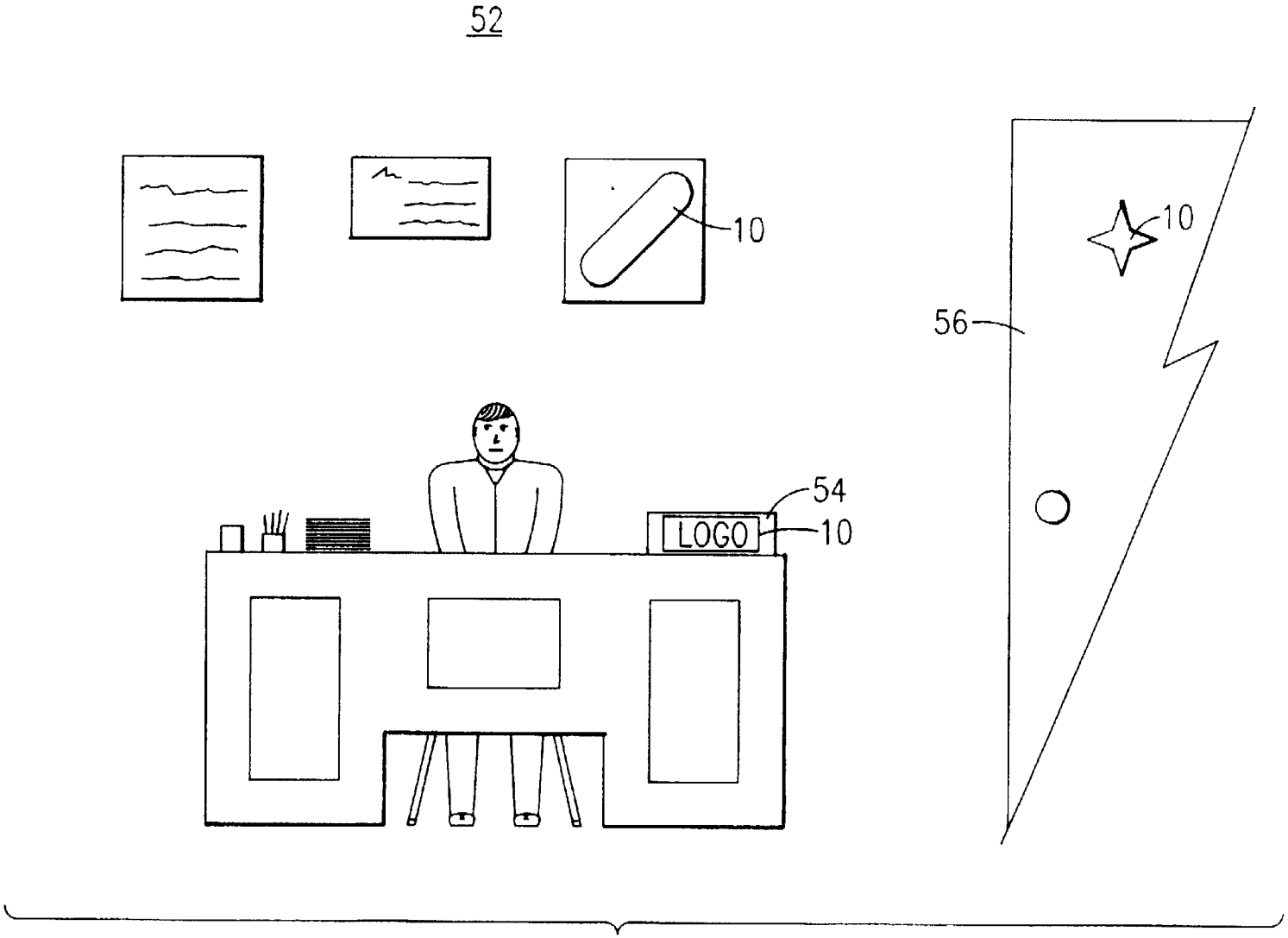
FIG. 5 illustrates the different embodiments of the present invention as shown in FIGS. 3*b*, 3*j*, and 33*c* attached to a wall, desk plaque, and door respectively.

FIG. 5 illustrates the exemplary embodiments of the present detachable golf equipment cleaning apparatus 10*b*, 10*j* and 10*c* shown in FIGS. 3*b*, 3*j* and 3*c* attached to a wall 52, desk plaque 54, and door 56 respectively.

From the foregoing detailed descriptions of particular embodiments of the invention, it will be apparent that a multi-use, multi-function, transportable golf equipment cleaning apparatus 10 has been disclosed which is provided with the capability of rapid, repetitive and selective placement for selective use as a cleaning apparatus or alternatively for use as a decorative, sales and marketing, or advertising tool. While the invention has been described above in connection with the particular embodiments and examples, one skilled in the art will appreciate that the invention is not necessarily so limited. It will thus be understood that numerous other embodiments, examples, uses, and departures from the teachings disclosed may be made, without departing from the scope of the present invention as claimed herein. The invention has been described herein in considerable detail in order to provide those skilled in the art with the information necessary to apply the novel principles and to construct and use such specialized components as are required. In view of the foregoing descriptions, it should be apparent that the present invention represents a significant departure from the prior art in construction and operation. However, while particular embodiments of the present invention have been described herein in detail, it is also to be understood that various alterations, modification and substitutions can be made therein without departing from the spirit and scope of the present invention, as defined in the claims which follow.

I claim:

1. A cleaning apparatus for cleaning golfing equipment and supplies comprising:

an adhesive adapted to bond with a substantially soft cloth material; and a substantially flat and flexible wiping element, said wiping element having a first face and a second face, wherein said first face is adapted with napping sufficient to loosen and remove debris and other unwanted matter clinging to said golfing equipment and supplies when any one of said equipment and supplies are rubbed against said first face, and further wherein said second face is adapted to bond with said adhesive such that slippage between said adhesive and said wiping element does not occur as said equipment and supplies are rubbed against said first face, and further wherein said wiping element and said adhesive bonded thereto are configured to be attached and detached to a person's skin a plurality of times with substantially no degradation in adhesive performance.

2. The cleaning apparatus of claim 1 wherein said adhesive is a pressure sensitive adhesive.

3. The cleaning apparatus of claim 2 further comprising a release backing sheet adapted with a release coating on one side of said release backing sheet, said side of said backing sheet having said release coating being temporarily bonded to said wiping element via said adhesive.

4. The cleaning apparatus of claim 3 wherein said second face is further adapted to bond with said adhesive such that said wiping element can be selectively attached to any one of a flat, curved, and irregular shaped surface.

5. The cleaning apparatus of claim 4 wherein said second face is further adapted to bond with said adhesive such that slippage between said wiping element and said any one of a flat, curved, and irregular shaped surface does not occur upon deformation of said any one of a flat, curved, and irregular shaped surface.

6. The cleaning apparatus of claim 5 wherein said second face is further adapted to bond with said adhesive such that said cleaning apparatus can be swiftly and easily detached from said any one of a flat, curved, and irregular shaped surface and selectively reattached to said any one of a flat, curved, and irregular shaped surface.

7. The cleaning apparatus of claim 6 wherein said wiping element comprises a fabric material.

8. The cleaning apparatus of claim 7 wherein said fabric material comprises a substantially moisture retentive material.

9. The cleaning apparatus of claim 8 wherein said first face further comprises a visible indicia selected from at least one of a artistic pattern, predetermined text, and a logo.

10. A cleaning apparatus comprising:

an adhesive adapted to bond with a predetermined fabric material; and a substantially flexible wiping element, said wiping element having a first face and a second face, wherein said first face comprises a surface adapted to loosen and remove unwanted matter clinging to selected golfing equipment and supplies when any one of said equipment and supplies are rubbed against said first face, and further wherein said second face comprises a surface adapted to bond with said adhesive such that said wiping element having said adhesive bonded thereto is configured to be selectively attached and detached to a person's skin a plurality of times wherein said wiping element having said adhesive bonded thereto retains its ability to be securely bonded to said person's skin and further wherein said wiping element retains its ability to loosen and remove said unwanted matter clinging to selected golfing equipment and supplies.

11. The cleaning apparatus of claim 10 wherein said adhesive is a pressure sensitive adhesive.

12. The cleaning apparatus of claim 11 further comprising a release backing sheet having a release coating on one side of said release backing sheet, said side of said backing sheet having said release coating being temporarily bonded to said wiping element via said adhesive.

13. The cleaning apparatus of claim 12 wherein said second face is further adapted to bond with said adhesive such that slippage between said any one of a flat, curved, and irregular shaped surface and said wiping element does not occur upon deformation of said any one of a flat, curved, and irregular shaped surface.

14. The cleaning apparatus of claim 13 wherein said wiping element comprises a moisture retentive fabric.

15. The cleaning apparatus of claim 14 wherein said first face further comprises a visible indicia selected from at least one of a artistic pattern, predetermined text, and a logo.

16. A multi-function golf equipment and supply cleaning apparatus comprising:

an adhesive adapted to bond with a substantially flexible fabric;

a substantially flat and flexible wiping element, said wiping element having a first face and a second face, said first face comprising means for removing debris and other unwanted matter clinging to selected golfing equipment and supplies when any one of said equipment and supplies are rubbed against said first face, said second face comprising means for bonding with said adhesive such that slippage between said adhesive and said wiping element does not occur as said equipment and supplies are rubbed against said first face; and means for attaching and detaching said wiping element having said adhesive bonded thereto onto a person's skin a plurality of times with substantially no degradation in adhesive performance.

17. The cleaning apparatus of claim 16 wherein said adhesive is further adapted to temporarily bond with a person's skin such that said wiping element conforms to a body portion to which said wiping element is attached.

18. The cleaning apparatus of claim 17 wherein said adhesive is pressure sensitive.

19. The cleaning apparatus of claim 18 wherein said fabric is moisture retentive.

20. The cleaning apparatus of claim 19 wherein said first face comprises visible indicia thereon, said visible indicia selected from at least one of a logo, artistic pattern, and predetermined text.

* * * * *